United States Patent [19]

Kozacka et al.

[11] 4,053,860

[45] Oct. 11, 1977

[54] ELECTRIC FUSE

[75] Inventors: Frederick J. Kozacka, South Hampton; Richard A. Belcher, Hampton Falls, both of N.H.

[73] Assignee: Gould, Inc., Newburyport, Mass.

[21] Appl. No.: 705,038

[22] Filed: July 14, 1976

[51] Int. Cl.[2] ..... H01H 85/04

[52] U.S. Cl. ..... 337/164; 337/295

[58] Field of Search ..... 337/163, 164, 166, 290, 337/292, 295, 296

[56] References Cited

U.S. PATENT DOCUMENTS 3,197,592 7/1965 Kozacka ..... 337/164

*Primary Examiner*—George Harris

*Attorney, Agent, or Firm*—Erwin Salzer

[57] ABSTRACT

An electric fuse suitable for motor-starting, i.e. having a considerable time-lag in the range of motor starting currents, and at the same time having a current-limiting action in the high fault current range, characterized by extremely small peak let-through currents and extremely small clearing $I^2 \cdot t$ values. To be more specific, fuses emboyding this invention have considerably smaller maximum peak let-through currents and considerably lower clearing $I^2 \cdot t$ values than Underwriter Laboratories Class RK5 fuses, and meet the maximum acceptable peak let-through current values and clearing $I^2 \cdot t$ values of Underwriter Laboratories Class RK1 fuses. This is achieved by combining specific time-lag means involving a minimum of mass with parallel current paths of greatly increased number and greatly decreased size.

7 Claims, 6 Drawing Figures

ELECTRIC FUSE

BACKGROUND OF THE INVENTION

Considerable time-lags in the range of motor starting currents can be achieved in a great number of different ways. We have found, however, that almost all of these ways are incompatible with the requirement of minimizing peak let-through currents and clearing $I^2 \cdot t$ values.

Simple solder joint fusible elements, or elements having overlays of solder, i.e. fusible elements which rely solely on the so-called M-effect, are hardly capable of producing considerable time-lags in the motor starting current range.

Fusible elements such as those disclosed in U.S. Pat. No. 2,321,711; June 15, 1943 to E. H. Taylor for FUSIBLE ELECTRIC PROTECTIVE DEVICE, are capable of producing considerable time-lags in the low current range, but incapable of meeting the requirements of minimal peak let-through currents and clearing $I^2 \cdot t$ values, mainly because according to this patent a substantial portion of the total length of the fuse is occupied by special low current time-lag interrupting means which do not contribute in any way to high fault current interruption.

The only fuse which meets long time-lag requirements in the motor starting current range, and whose fusible elements can be manipulated or changed in such a way as to minimize peak let-through currents and clearing $I^2 \cdot t$ is that disclosed in U.S. Pat. No. 3,189,712; June 15, 1965 for HIGH INTERRUPTING CAPACITY FUSE. The fuse disclosed in that patent is capable of achieving in the motor starting current range satisfactory time-lags. The fuse links of this fuse extend along the preponderant length of the casing and can, therefore, be tailored to meet let-through current and clearing $I^2 \cdot t$ requirements. According to this invention the ratio of the diameters of the transverse lines of circular perforations must be in the order of 6:1 and the cross-sectional area of each of the solid metal current paths between perforations must be in the order of 0.00005 to 0.000075 square inches. These are critical values. By following them, the peak let-through amperage can be reduced to smaller values than specified in Underwriters Standards RK5, and to meet the requirements of Underwriter Standards RK1. The above geometry results, however, in a reduction of the length of the current path between the circular perforations, and hence in a reduction of the arc voltage generated. This, in turn, results in an increase of the clearing $I^2 \cdot t$ values above those permitted by the Underwriter Standards. This limitation can, however, be remedied by increasing the number of transverse lines of circular perforations. Thus a fuse according to U.S. Pat. No. 3,189,712 meeting Underwriter Standard RK5 and designed for a circuit voltage of 250 volts has three transverse lines of circular perforations, while the above dimensions in regard to the size of the perforations and that of the intervening portions call for the presence of an additional transverse line perforation, i.e. a total of four lines. Similarly, a fuse according to U.S. Pat. No. 3,189,712 meeting Underwriter Standard RK5 and designed for a circuit voltage of 600 volts had five transverse lines of circular perforations, but the reduction of arc voltage resulting from the above perforation size and inter-perforation metal bridge size with its attendent reduction of arc voltage calls for six rather than five transverse lines of circular perforations.

SUMMARY OF THE INVENTION

An electric fuse embodying this invention includes a pair of parallel connected fusible elements in ribbon form having a pair of parallel center portions and lateral portions enclosing acute angles with said center portions. Said center portions having sides affixed to a pair of blades contacts, while said lateral portions are non-connected to said pair of blade contacts. A casing houses the pair of fusible elements and also a granular arc-quenching filler embedding said pair of fusible elements. Overlays of a metal having a lower fusing point than the metal of which the pair of fusible elements are made is arranged on said pair of fusible elements to cause interruption of said pair of fusible elements at temperatures below the fusing point of the metal of which said pair of fusible elements are made. A plurality of lines of transverse circular perforations is provided on said pair of fusible elements. Said lines of perforations extend from edge to edge of each of said pair of fusible elements. The ratio of the diameter of said perforations to the metal current paths therebetween is in the order of 6:1. The cross-sectional area of each said solid current path is in the order of 0.00005 to 0.000075. The metal of which the fusible elements are made is sheet copper, or sheet silver, having thicknesses from 0.005 to 0.0075. The diameter of the constituent perforations of said transverse line of perforations is 0.0625.

DESCRIPTION OF PREFERRED EMBODIMENTS

Figure 1:
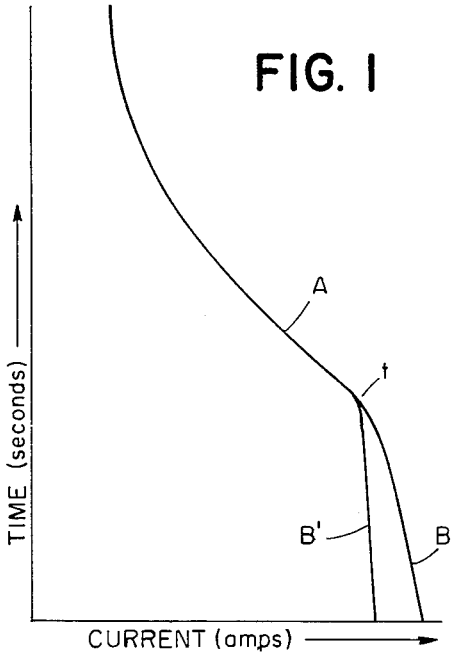
FIG. 1 is a diagrammatic representation of the time current curves of Underwriters Laboratories time current curves for RK5 fuses and for RK1 fuses, respectively.

Referring now to the drawings, FIG. 1 shows times in seconds plotted versus currents in amps. The abscissae and ordinates have been drawn on a logarithmic scale, but do not conform with actual test data. The curves of FIG. 1 have been shown in such a way as to make the invention clear rather than to reflect actual tests. Reference numeral A has been applied to indicate a time-current curve as obtained with a current limiting fuse according to U.S. Pat. No. 3,189,712. Point t is the point where the so-called M-effect takes over, i.e. where the metal of a lower fusing point than the base metal melts and initiates interruption. For currents left to point *t* to single parallel breaks are formed in the pair of fusible elements. For points right to point *t* series breaks are formed in the pair of fusible elements. The section B left from point *t* indicates the operation of a fuse according to U.S. Pat. No. 3,189,712, while the section B' left from point $t$ indicates the operation of a fuse embodying the present invention.

Figure 2:
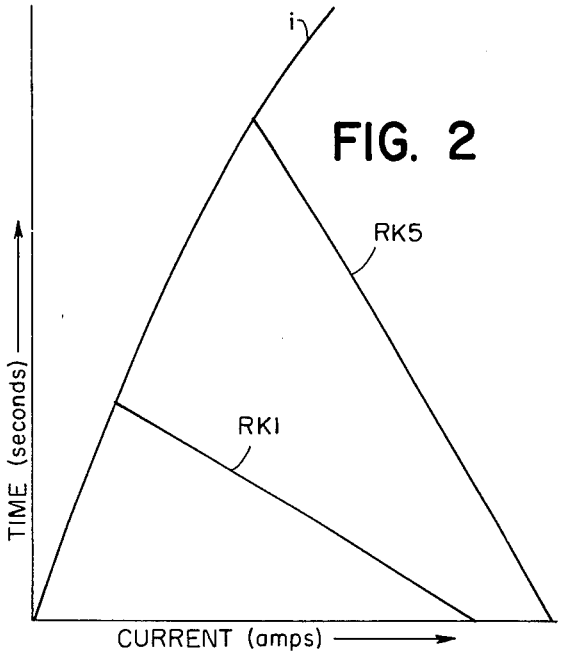
FIG. 2 is a diagrammatic representation of the current trace of an Underwriters Laboratories RK5 fuse and RK1 fuse, respectively.

In FIG. 2 the current wave $i$ is shown to be interrupted once by an Underwriters Laboratories RK5 fuse and then by an RK1 fuse. The qualitative differences between both kinds of fuses are immediately apparent from FIG. 2. The quantitative differences between both kinds of fuses are indicated in the tables below:

MAXIMUM ACCEPTABLE PEAK LET-THROUGH CURRENT (Ip) AND CLEARING $I^2t$ FOR CLASS RK5 FUSES

| Cartridge Size | Between Threshold and 50KA | | 100KA | | 200KA | |
|---|---|---|---|---|---|---|
| amps | $I^2t \times 10^3$ | $Op \times 10^3$ | $I^2t \times 10^3$ | $Ip \times 10^3$ | $I^2t \times 10^3$ | $Ip \times 10^3$ |
| 0–30 | 50 | 11 | 50 | 11 | 50 | 14 |
| 31–60 | 200 | 20 | 200 | 21 | 200 | 26 |
| 61–100 | 500 | 22 | 500 | 25 | 500 | 32 |
| 101–200 | 1600 | 32 | 1600 | 40 | 2000 | 50 |
| 201–400 | 5000 | 50 | 5000 | 60 | 6000 | 75 |
| 401–600 | 10000 | 65 | 100000 | 80 | 12000 | 100 |

MAXIMUM ACCEPTABLE PEAK LET-THROUGH CURRENT (Ip) AND CLEARING $I^2t$ FOR CLASS RK1 FUSES

| Cartridge | Between Threshold and 50KA | | 100KA | | 200KA | |
|---|---|---|---|---|---|---|
| Size | $I^2t \times 10^3$ | $Ip \times 10^3$ | $I^2t \times 10^3$ | $Ip \times 10^3$ | $I^2t \times 10^3$ | $Ip \times 10^3$ |
| 0–30 | 10 | 6 | 10 | 10 | 11 | 12 |
| 31–60 | 40 | 10 | 40 | 12 | 50 | 16 |
| 61–100 | 100 | 14 | 100 | 16 | 100 | 20 |
| 101–200 | 400 | 18 | 400 | 22 | 400 | 30 |
| 201–400 | 1200 | 33 | 1200 | 35 | 1600 | 50 |
| 401–600 | 3000 | 43 | 3000 | 50 | 4000 | 70 |

Figure 3:
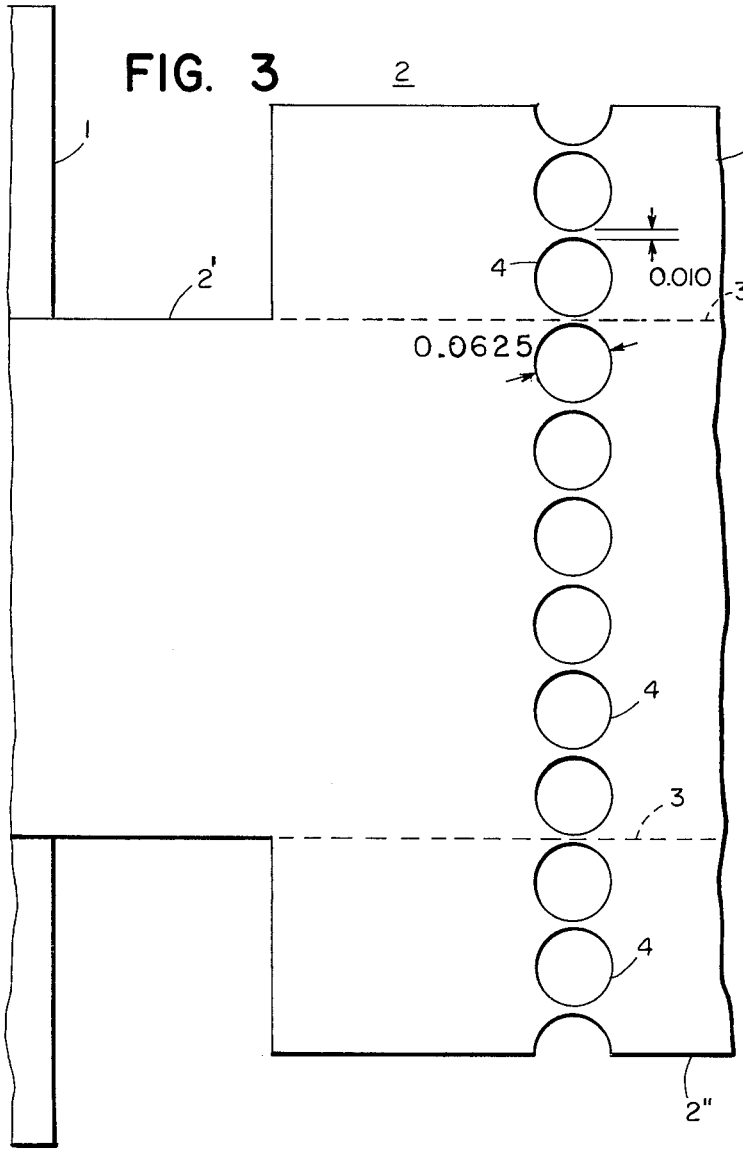
FIG. 3 is a diagrammatic representation of a piece of stamped sheet-metal used to form the fusible elements embodying the present invention.

Referring now to FIG. 3, numeral 1 has been applied to one of a pair of blade contacts to which fusible element 2 is conductively connected. Fusible element 2 includes the center portion 2′ and the two lateral portions 2″. The latter are intended to be bent in regard to center portion 2′ along lines 3 at acute angles. The drawing shows one of the several lines of circular perforations 4 which extend from one of the edges of stamping 2 to the other edge thereof. The total number of perforations is 10 plus two half perforations. The ratio of perforations to the solid metal current paths between perforations is in the order of 6:1 and the cross-sectional area of each said solid metal current paths is in the order of 0.00005 to 0.000075 square inches. Stamping 2 is of sheet silver and its thickness is in the order of 0.005 to 0.0075. The diameter of circular perforations is 0.0625.

Figure 4:
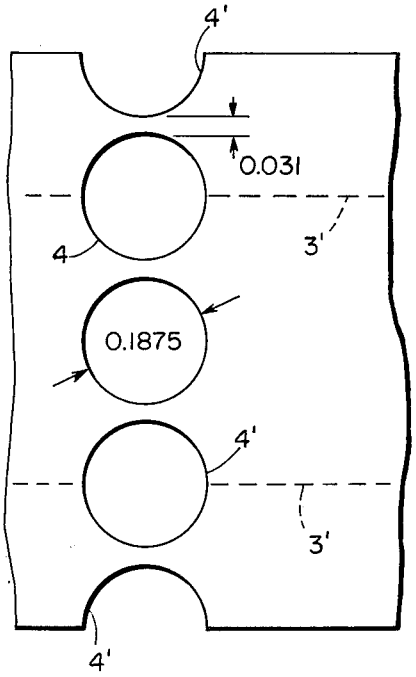
FIG. 4 is a diagrammatic representation of a piece of stamped sheet metal used to form fusible elements of prior art fuses.

FIG. 4 shows for purpose of comparison a fusible element as actually used to manufacture fuses according to U.S. Pat. No. 3,189,712. The fuses include several transverse lines of circular perforations 4′ of which but one line is shown in FIG. 4. Each line includes three full perforations 4′ and two half perforations 4′ and the stamping is supposed to be folded along lines 3′ to form a channel-shaped structure. The diameter of perforations 4′ is 0.1875 and the width of the necks which they form is 0.031, while the diameter of the circular perforations 4 of FIG. 3 is but 0.0625 and the width of the necks which are formed therebetween is but 0.010.

This difference in size has several crucial effects. The most important of these effects is that the sum total of the resistance of a relatively large number of relatively narrow current paths in parallel is less than the resistance of a more limited number of current paths of relatively large cross-sectional area. In other words, the resistance of a given cross-sectional area of fixed size decreases, the larger the subdivision of that area in separate parallel current paths. This fact is one of the building blocks upon which the present invention is based.

It follows from the above that a further decrease of the cross-section of the necks between perforations 4 may be desirable, though not necessary. This is theoretically correct, but it is impractical to produce stampings having circular perforations substantially less than 0.010 apart from each other, particularly if the thickness of the material is to be as thin as 0.005 to 0.0075.

The smallness of the perforations — compare FIGS. 3 and 4 — has another effect which consists in the fact — mentioned above — that the length of the sections of reduced cross-section formed between the circular perforations decreases as the diameters of the perforations decreases. The length of these sections determines the back-turn velocity which, in turn, has an effect on the arc voltage. The smaller the diameter of the circular perforations 4, the shorter the length of the intermediate current-carrying bridges and the smaller the arc voltage. This must be compensated by the addition of at least one transverse line of circular perforations. Thus a fuse link according to FIG. 4 rated 600 volts calls for five lines of circular perforations, while a fuse link rated 600 volts according to FIG. 3 calls for six lines of circular perforations.

The fuses according to this invention have apparently further distinctions from prior art fuses which have, however, but a limited bearing on the invention and, will therefore, but briefly be touched upon. When the dimensions of a plurality of parallel connected points of reduced cross-sectional area are reduced in the way that has been indicated above, the heat capacity of the necks thus formed decreases, the temperature gradient with the surrounding medium increases, and it appears no longer permissible to rely on the $i^2 \cdot t$=constant law. However, since current-limitation is expected in the range of very high currents, heat dissipation is a matter of secondary order.

Figure 5:
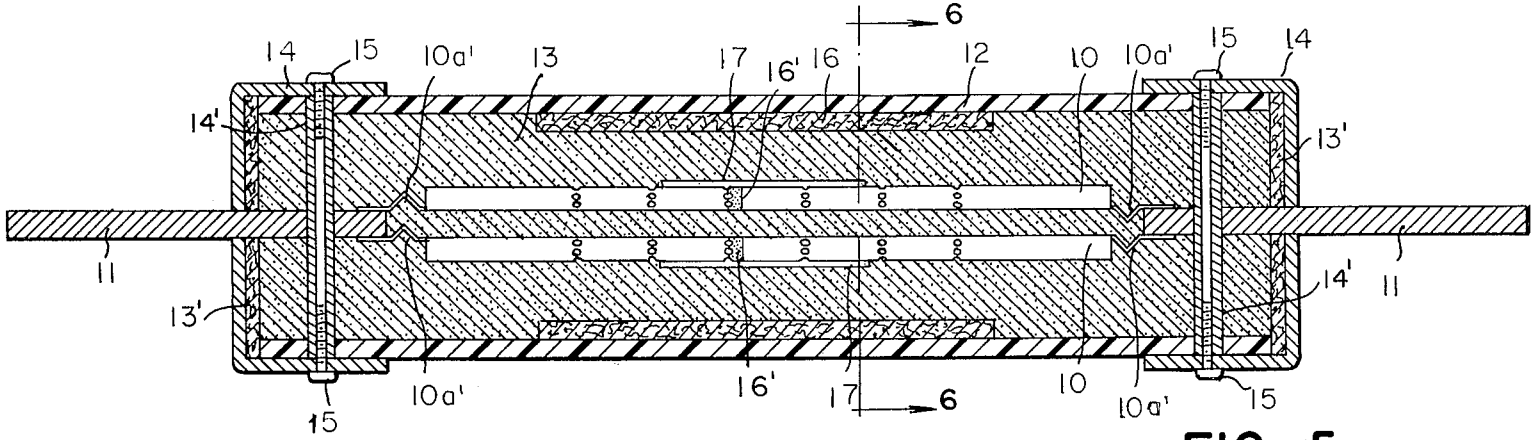
FIG. 5 is substantially a longitudinal section of a fuse embodying the present invention.
Figure 6:
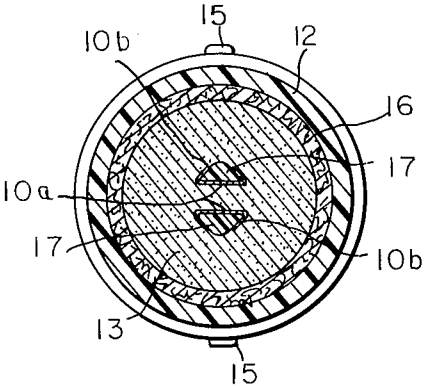
FIG. 6 is a cross-section of the fuse shown in FIG. 5 taken along 6—6 of FIG. 5.

Referring now to FIGS. 5 and 6, numeral 10 has been applied to indicate a pair of fusible elements each having a pair of parallel center portions 10*a* and lateral portions 10*b* enclosing acute angles with said center portions. The center portions 10*a* are affixed to opposite sides of blade contact 11 and the center portions 10*a* have zig-zaging ends 10*a*′ enabling thermal expansion and contraction of the fusible elements. The lateral portions 10*b* are not connected to the pair of blade contacts 11, except through the center portions 10*a*. The casing 12 houses said pair of fusible elements 10*a*, 10*b* and a granular arc-quenching filler 13. Filler 13 consists of quartz sand which embeds said pair of fusible elements 10*a*, 10*b*. Washers 13′ are arranged at the ends of casing 12 and terminal caps or ferrules 14 are mounted on the ends of casing 12. The blade contacts 11 are mounted on hollow pins 14′ into the ends of which screw nails 15 are driven.

The time-lag in the overload range is achieved by the configuration of fusible elements 10*a*, 10*b* combined with overlays 16′ of a metal having a lower fusing point than the metal of which the fusible elements 10*a*, 10*b* are made. As mentioned above, the base metal of which elements 10*a*, 10*b* are made may be silver, or also copper, and the overlay metal may be, for example, tin. When the tin melts, a metallurgical reaction takes place as a result of which fusible elements 10*a*, 10*b* are severed, or interrupted. The requisite time-lag may not be achieved if the radial heat flow is excessive. In that instance it is necessary to provide means that reduce the radial heat flow as, e.g. the sleeve 16 of asbestos or of an equivalent thermal insulator. The effect of sleeve 16 is to reduce the thermal conductivity of the structure in terms of Btu/hr/squ ft/of/ft, e.i. to derate the fuse.

Quenching of the low current arc may greatly be facilitated by wrapping each of said pair of fusible elements 10*a*, 10*b* around a bar 17 of gas-evolving material, e.g. a mixture of melamine resin and inorganic fillers, having a smaller perimeter than the cross-sectional area of each of said fusible elements. This design and its mode of operation has been disclosed in detail in U.S. Pat. No. 3,935,553; Jan. 27, 1976 to Frederick J. Kozacka et al, and reference may be had to this patent for further information on this particular detail.

We claim as our invention:

1. An electric fuse including a. a pair of parallel connected fusible elements each having a pair of parallel center portions and lateral portions enclosing acute angles with said center portions;

b. said center portions having sides affixed to a pair of blade contacts while said lateral portions are non-connected to said pair of blade contacts;

c. a casing housing said pair of fusible elements and a granular arc-quenching filler inside said casing embedding said pair of fusible elements;

d. overlays of a metal having a lower fusing point than the metal of which said pair of elements are made arranged on said pair of fusible elements to cause interruption of said pair of fusible elements at temperatures below the fusing point of the metal of which said pair of fusible elements are made; and e. a plurality of transverse lines of circular perforations in each of said pair of fusible elements, said lines of perforations from edge to edge of each of said pair of fusible elements and the ratio of the diameter of said perforations to the solid metal current paths therebetween being in the order of 6:1, and the cross-sectional area of each said solid metal current paths being in the order of 0.00005 to 0.000075 inch.

2. An electric fuse as specified in claim 1 for application in circuits having a circuit voltage of 250 and 600 volts, respectively, wherein said plurality of lines of circular perforations is four and six, respectively.

3. An electric fuse as specified in claim 1 wherein said pair of fusible elements are of sheet-silver having a thickness of 0.005 to 0.0075 inch, and wherein the diameter of the constitutent perforations of said transverse lines of circular perforations is 0.0625 inch.

4. An electric fuse including a. a pair of parallel connected fusible elements each having a thickness of 0.005–0.0075 inch and each comprising a center portion and a pair of lateral portions enclosing acute angles with said center portion;

b. a pair of blade contacts supporting on opposite sides thereof the ends of said center portion of each of said pair of fusible elements;

c. a casing housing said pair of fusible elements;

d. a granular quartz sand filler within said casing embedding said pair of fusible elements;

e. overlays of a metal having a lower fusing point than the metal of which said pair of fusible elements are made arranged on said pair of fusible elements to cause interruption of said pair of fusible elements at temperatures below the fusing point of the metal of which said pair of fusible elements are made; and f. a plurality of transverse lines of perforations in each of said pair of fusible elements, said lines of perforations extending from edge to edge of each of said pair of fusible elements and the constituent perforations of said lines having a diameter in the order of 0.062 and defining solid metal portions of restricted cross-sectional area therebetween having a width in the order of 0.01 inch.

5. An electric fuse as specified in claim 4 for application in circuits having a circuit voltage of 250 and 600 volts, respectively, wherein said plurality of lines of circular perforations is four and six, respectively.

6. An electric fuse as specified in claim 4 wherein each of said pair of fusible elements is wrapped around a bar of gas-evolving material having a smaller perimeter than the cross-sectional area of each of said fusible elements.

7. An electric fuse as specified in claim 4 wherein the radial heat flow is reduced by the interposition between said casing and said arc-quenching filler of a heat flow restrictive sleeve reducing the thermal conductivity in terms of Btu/hr/sq ft° f/ft.

* * * * *